United States Patent [19]

Galanty

[11] Patent Number: 4,491,278

[45] Date of Patent: Jan. 1, 1985

[54] COMMINUTOR FOR INLINE FLOW OF SEWAGE

[76] Inventor: William B. Galanty, One Argle Ct., Livingston, N.J. 07039

[21] Appl. No.: 575,306

[22] Filed: Jan. 30, 1984

[51] Int. Cl.[3] ..... B02C 23/36

[52] U.S. Cl. ..... 241/46.06; 241/243

[58] Field of Search ..... 210/173, 174, 359; 241/46.06, 46.08, 46.15, 46 A, 46 B, DIG. 38, 242, 243

[56] References Cited

U.S. PATENT DOCUMENTS 2,241,587 5/1941 Durdin, Jr. ..... 241/46.06 X 4,186,888 2/1980 Galanty ..... 241/46.06

*Primary Examiner*—Mark Rosenbaum

*Attorney, Agent, or Firm*—Clay Holland, Jr.

[57] ABSTRACT

An improved comminutor is provided having a one piece stationary hemispherical cage member and a one piece spherical-like rotatable cutting and shredding member adapted for use with the hemispherical cage in comminuting action with the inline flow of sewage. The hemispherical cage structure is formed by a plurality of spaced apart arcuate elements disposed about an axis of said hemispherical cage and are interconnected at their diametrical ends by a circular comb-like section configuration thereof having a plurality of radially inward projecting teeth. Each arcuate element has one of said teeth disposed at the terminal ends thereof, in alignment therewith and forming an integral part thereof. The rotatable structure of the device in its preferred embodiment incudes at least two substantially diametrically opposed C-shaped or curved arms of predetermined width and may be disposed co-axially with said cage and in the path of sewage flow while having a plurality of cutting and shredding teeth formed thereon and in spaced-apart relationship with the hemispherical cage for interengaging comminuting action with the radially extending teeth portions of the stationary comb-like section and for sweeping through the slots formed in the cage. The teeth of the cutting and shredding arms of the rotatable arcuate-like members are in rotational interengagement relationship with the periphically disposed comb-like section of the cage for comminuting sewage at least once during each revolution of the cutting and shredding arms.

6 Claims, 3 Drawing Figures

COMMINUTOR FOR INLINE FLOW OF SEWAGE

BACKGROUND OF THE INVENTION

This invention relates to comminutor devices having significant solid material content carried by a flowing liquid, such as sewage for example, in an in-line pipe system. The present invention is concerned primarily with an improved stationary cage structure and an improved rotatable cutting and shredding member. In the prior art comminutors may have had fixed cages generally formed of a plurality of individual axially spaced-apart sections forming slots for the passage of the comminuted sewage, such devices may also have associated separte stationary cutting and shredding bars, commonly referred to as cutter bars connected to such cages, in proximity to the bars having teeth formed thereon which may be in axial alignment with corresponding sections of the slots formed in the fixed cage. The comminutor may have further means mounted in close spaced relationship with the fixed cage and separate cutter bars for interengaging comminuting action.

Comminutors of the foregoing types are well known and described in the prior art, for example such as in U.S. Pat. No. 2,305,935, to George L. Thon, issued Dec. 22, 1942. In this device the comminution of material contained in the sewage is accomplished by a slotted straining member, either stationary or rotary, which intercepts pieces of material which are too large to pass through the strainer slots and having cutting teeth which cooperate with one or more associated notched cutting bars to cut, shrear or tear intercepted solids into pieces small enough to pass through the slots. In operation, comminution of the solid materials occurs on the concave side of the strainer where a plurality of cutting teeth are disposed in the path of travel of the notches in the cutting bar, either one or more spaced about the axis of rotation of such bar or bars, whereby pieces are cut, shreared or torn from the solids that are caught between the cutting bar or bars and the cutting teeth.

U.S. Pat. No. 2,389,309, to Walter H. Green, issued Nov. 20, 1945, discloses in its preferred embodiment, a fixed semi-cylindrical grid forming a plurality of horizontal slots extending circumferentially to the grid having a plurality of rotatable circular discs having cutting teeth on the peripheries of the discs by extending through the slots of the grid and a vertical cutter bar set into the wall of the conduit extending vertically along the periphery of the rotatable discs. In operation, larger solids in the sewage are first caught or held by the upstream segments of the rotating plate which extend outwardly beyond the bars of the fixed grid, and will be nibbled away by the rotating or washed or carried over to the cutter bar. Thus, such solids are caught between the cutting bar and into the down stream flow of sewage.

U.S. Pat. No. 2,594,785, to Herbert J. Meeker, issued Apr. 29, 1952, discloses a comminutor having a vertical stationary semi-cylindrical bar cage having a plurality of screening openings therein, further having one or more internal oscillating cutter arms together with means for oscillating the cutter arms backwards and forwards over the concave surface of the cage. Each cutter arm carries shredding teeth which cooperate with shredding teeth removably carried by the bar cage to cut and shred collected screening openings in the semi-cylindrical cage. The cutter bar attached to the oscillating cutter arm or arms extends vertically across the inner concave surface of the semi-cylindrical cage at an acute angle such that the desired shrearing action occurs advantageously.

U.S. Pat. No. 4,186,888, to William B. Galanty, the present inventor, issued Feb. 5, 1980, discloses a comminutor primarily for channels that carry the flow of liquid sewage which includes a stationary semi-cylindrical concave cage formed of a plurality of axially spaced-apart individual sections of arcuate rings or bars connected together arcuately and axially. A plurality of separate comb-like members are mounted vertically at predetermined spaced intervals along the inner surface contour of the semi-cylindrical concave cage member with the teeth of its comb-like members in axial alignment with corresponding sections of the rings or bars which form the cage member. A plurality of rotatable cutting and shredding arms are mounted axially along a helical spiral-like path extending radially from an axially disposed shaft, in spaced relationship with the cage member and the plurality of comb-like members for interengaging comminuting action with radially extending portions of their respective teeth. The teeth of the cutting and shredding arms may be in engagement with each tooth of the comb-like members and each of the slotted openings of the cage member at least once during each revolution of the cutting and shredding arms.

SUMMARY OF THE INVENTION

The present invention relates to an improved communitor device having an improved one piece stationary hemispherical-shaped slotted cage with self contained or integrally built-in cutter-teeth and an improved one piece rotatable cutting and shredding structure in spaced-apart comminuting relationship which substantially reduces structural obstructions to the flow of sewage through the device during its operation, while providing smoother and vibration free comminuting action. The novelty of the device resides primarily in the improvement presented in the one piece slotted cage with integrally built-in cutter-teeth and the one piece rotatable cutting and shredding structure, both of which are readily adapted to mass production techniques, such as metal casting or forging, as contrasted to the prior art technique of manufacturing individual component parts and the assembly and fitting together thereof. In accordance with the present invention the cage may be casted of 40 C STAINLESS STEEL, for example, and is useable directly as casted. The rotatable cutting and shredding structure may also be casted of 40 C STAINLESS STEEL, for example, and may require only minor machining, grinding or filing of the cutting and shredding teeth to provide smooth vibration-free interengagement action with the stationary cage cutter-teeth. In other cases these elements may be casted of stainless steel and finished with other chrome boride fused coating for high abrasion resistance properties.

The use of comminuting devices primarily for in-line pipe systems dictates that the device must be extremely reliable and durable once it is put into operation because of the inaccessability of the comminutor and its various parts. In the comminutor industry it has been thought, but never accomplished heretofore, that the reliability of such devices could possibly be enhanced and greatly improved by reducing the number of assembled parts utilized in such systems, owing to the fact that dimensional relationships may be better controlled. Thus, it has been found in accordance with the present invention, that use of the one piece casted structures, for example, of the present invention substantially improves the reliability, durability and energy efficiency of the comminutor for in-line operation, to thereby solve a long standing problem in the industry. In addition to enhanced reliability, the present invention provides a number of additional advantages. These advantages include the elimination of an axial drive shaft or post, required in many prior art devices for driving the rotatable cutting and shredding members. The elimination of the axial shaft also substantially reduces, if not eliminates, obstructions to the flow of sewage material. The unitary construction for both the slotted cage and rotatable member significantly enhances and improves the strength and ruggedness of each member. This has been found to be especially so in the case of the slotted cage, which may have thin elements when they extend over a large arcuate length.

More specifically, the arcuate elements of the cage are an integral part of the cutter-teeth section which are located at the diametrical ends of these elements. The one piece structures of both members also provides greater uniformity in the dimensions for each structure, which in turn tends to minimize vibrations within the system between these two principal cooperating parts during system operation and whenever they are required to be replaced. In the instance of the rotatable member, the formation of the cutting and shredding teeth can be made significantly thinner with small spacing between the adjacent teeth. With such a configuration, the rotatable member of the device is adaptable for finer shredding action which in turn enhances and/or facilitates processing sewage which has passed through the cage of the device.

It is an object of the invention to provide an improved comminutor system for solid materials in sewage liquid flow in closed in-line pipe systems where accessability is impractical and costly for making repairs or changes or eliminating clogs or flow stoppages once the system is placed in operation.

A further object of the invention is the provision of a device in which the several parts are structurally and mechanically stronger, more duriable and reliable than similar parts in the prior art devices.

Still another object of the invention is the provision of a device in which the vibrations between the stationary and moving parts thereof during its operation are minimized, if not eliminated.

Yet another object of the invention is the provision of a more energy efficient device with lower back pressure because of better sewage flow owing to the absence of an axial drive shaft or post which has been used in prior art devices and which tend to obstruct sewage flow, thereby causing higher back pressures than are desired.

Still a further object of the invention is the provision of a comminutor device in which the sewage flow therethrough is comminuted to significantly finer particle size owing to the presence of cutting and shredding teeth formed on the arcuate arms of the rotatable member which may be unusually thin in thickness to thereby produce such finer particle size sewage when utilized with cages also having narrower axial spacing between the circular cage elements.

Yet a further object of the invention is the provision of a comminutor system wherein the rotatable member is capable of rotation in either direction, ie clockwise or counter-clockwise about the axis of the system.

The above stated and other objects of the invention are achieved by the provision of a comminutor having fewer parts, including a one piece structured metal stationary cup-like cage formed by a plurality of spaced-apart arcuate elements which have at their diametrical ends a plurality of radially projecting cutter-teeth forming a comb-like integral section and a one piece structured rotor with cutting and shredding teeth on at least two diametrically arcuate arms for rotational action without an obstructing axial shaft.

BRIEF DESCRIPTION OF THE DRAWINGS

Realization of the above unique features and advantages along with other of the present invention will be apparent from the following description and accompanying drawings in which.

DESCRIPTION OF REPRESENTATIVE EMBODIMENT OF THE INVENTION

Figure 1:
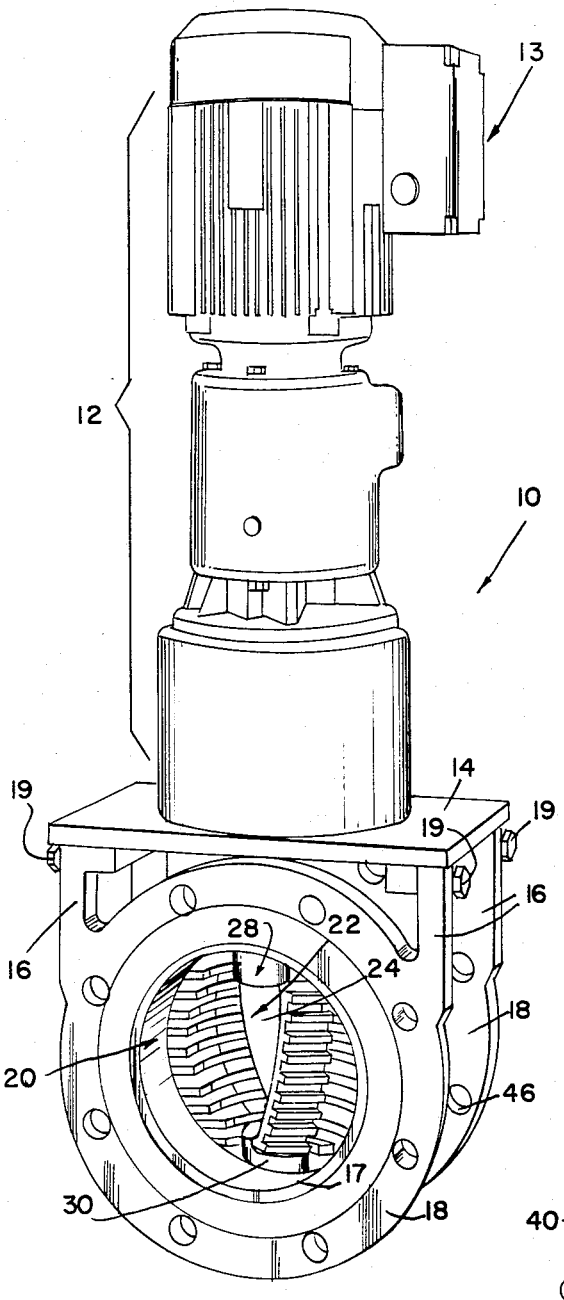
FIG. 1 is a detail perspective view of an entire comminuting device embodying the present invention.

Referring to the drawings, there is shown in FIG. 1, the improved in-line comminutor system 10 which includes a drive motor system 12 including an electrical control device 13, supported by a motor mount plate arrangement 14.

The motor mount plate arrangement 14, is connected to a plurality of pipe flange arms 16, which are extensions of circular flanges 18, by a plurality of bolts 19 which in turn form part of the housing for a stationary hemispherical comminutor cage 20 and a support for a rotatable mounted cutting and shredding member 22. As shown in FIG. 1, the drive motor assembly 12 is connected to the improved in-line comminutor system 10, from the top through motor mount plate arrangement 14.

As seen in FIG. 1, rotatable member 22 is supported within pipe section 17 in substantial axial alignment with drive motor system 12. Rotatable mounted cutting and shredding member 22 is interconnected to drive motor system 12 through motor mount plate 14 and is rotated by the motor system as a part or extension of the drive shaft of the motor system. Rotatable member 22 may be driven rotationally in the counter-clockwise or clockwise directions by electrical control device 13 of drive motor system 12.

Figure 2:
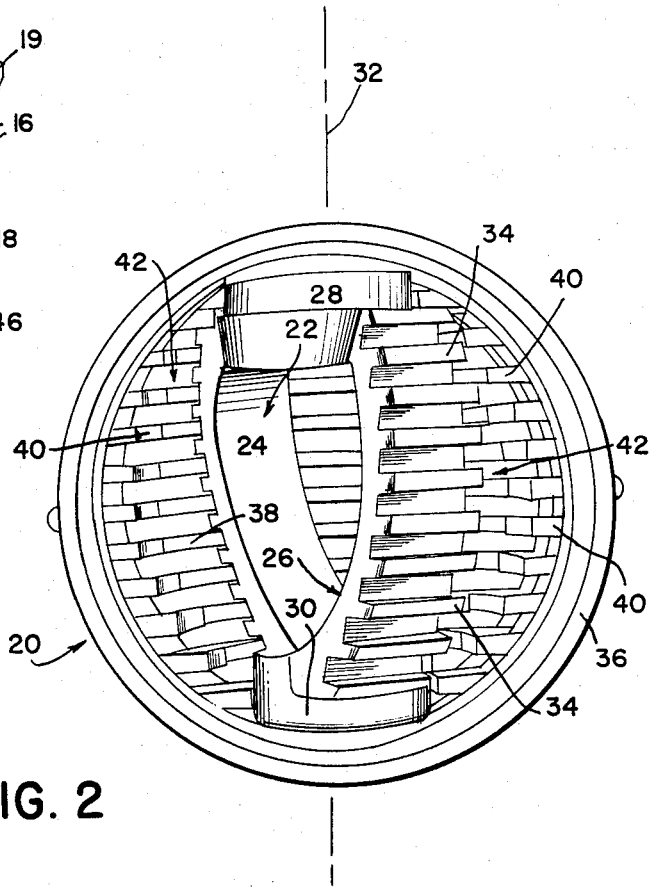
FIG. 2 is an enlarged detaitl perspective view of the rotatable cutting and shredding one piece metal structured member and the stationary hemispherical cage member, illustrating the construction thereof, including support sections of the rotatable member along its axis and the absence of an conventional axial drive shaft between the axial support members.

Referring now to FIG. 2 there is shown an enlarged perspective view of the rotatable cutting and shredding member 22. As shown, member 22 includes two diameterically opposed arcuate-like arms 24 and 26 which are joined each at one end by a circular or ring-like support section 28 and at the other end by a second support section 30. These sections are disposed along an axis 32 of member 22 and are used as the means for supporting member 22 within comminutor 10. Along the periphery of arms 24 and 26 are a plurality of spaced-apart cutting and shredding teeth 34. As shown in FIG. 2, teeth 34 extend radially outward from the axis for interengagement and intermeshing relationship with cage 20.

In FIG. 2, it can be seen that rotatable member 22 is supported adjacent cage 20 at the top by section 28 and at the lower other end by section 30. The details of the means for supporting rotor member 22 at its lower end is not shown. However, member 22 is ridigedly mounted and supported within the device by means of a bushing arrangement and by drive motor system 12 without the traditional attendant drive shaft passing within the flow path of sewage through the device. This unique construction provides a definite advantage during operation of the device, in that the absence of a shaft along the axis in the path of sewage flow eliminates possible cause of any significant obstruction or blockage of the flow while significantly decreasing the back pressure of such flow. The elimination of possible blockage accounts in a large measure for the reduction of head losses and increases flow capacity, due to increased open area of the spherical configuration of the cage.

Figure 3:
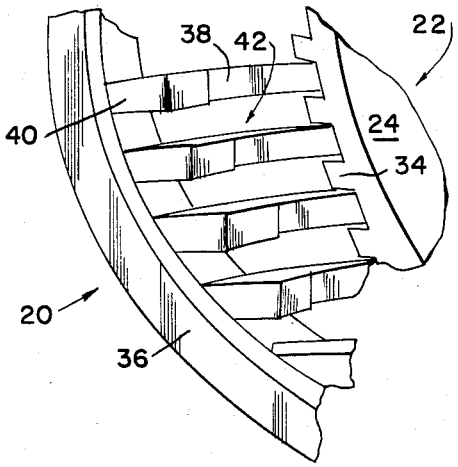
FIG. 3 is a fragmentary enlarged view of a section of the cage and several cutter teeth of the rotatable member near the periphery of the stationary hemispherical cage.

Referring to FIG. 3, it can be seen that the stationary hemspherical cage 20, as viewed from the front or upstream side thereof, is formed by a diametrical or peripherical outer liner section 36 connected to a plurality of stationary axially spaced-apart arcuate ring sections 38 and a plurality of cutter teeth 40, connected together arcuately and axially. These ring-like sections 38 are supported by and terminate at their arcuate ends by said plurality of peripherically disposed cutter teeth 40. The axially spaced-apart rings 38 and teeth 40 form a plurality of spaced-apart slotted openings 42 cutting cage 20 in planes perpendicular to the axis of the device. The slotted openings 42 formed by the ring sections 38 and teeth 40 have an arcuate configuration conforming to and forming the convex surface of the cage 20, at the rear or down stream position of the device.

Still referring to FIG. 3, there is shown an enlarged fragmentary perspective view of cage 20, depicting the peripherical liner section 36. As depicted in FIG. 3, section 36, ring 38 and cutter-teeth 40 form a unitary juncture where the three elements meet. This feature of construction, which is the result of metal forming of cage 20, provides a cage structure which has proven to be substantially stronger mechanically and more durable than any prior art system arrangements or constructions, and consequently produces a more reliable structure during operation of the device. Another advantage derived from this construction is that of eliminating the need to perform additional fabrication work to the cage such as milling, grinding or filing of the cutter-teeth 40 prior to the cage being put into direct use in the device.

To continue with the description of the device and its operation, specific attention is directed to FIG. 2, where it can be seen that arcuate cutting and shredding arms 24 and 26 are disposed about an axis 32 of the cage 20, and some instances may be co-axial or co-parallel with the axis of rotor 22, depending upon sizes and spaced-apart distances between cage 20 and rotatable member 22. As shown in FIG. 2, a plurality of teeth 34 extend substantially radially in relation to the axis and penatrates slots 42 during rotation of arms 24 and 26. However, the relationships between cutter-teeth 40 of cage 20 and cutting teeth 34 of member 22 is one of interengagement therebetween. More specifically, the interengagement action between the stationary teeth 40 and rotating teeth 34 is one of shearing and tearing and the like. The various materials which are found in the flow of sewage caught between these interengaging members and are comminuted to sizes during multiple revolutions of member 22 which permits the materials so reduced in size to flow through slots 42 from the up-stream to the down-stream side of the cage.

It should be noted at this time or point that teeth 34 of arcuate arms 24 and 26 may be thinner in axial thickness than known prior art devices owing to the fact that teeth 34 do not extend radially from the axis of the device connected to an axially disposed post or shaft , but extends from hub-like arcuate arms 24 and 26. This feature of construction along with the fact that the rotatable member is of unitary body construction, substantially enhances and improves the efficiency of the present inventive system which enables the device to shred the sewage flow of material into finer particle sizes.

The present inventor, envisioned that his prior art semi-cylindrical concave cage device disclosed hereinabove could be modified easily and simply to provide some of the functional capabilities of the present invention. However, realization of a workable improvement of such prior art device was not easily and/or obviously accomplished until he overcame the unobvious aspects thereof. The most difficult and unobvious aspect dealt with the need to have a device with fewer parts and to have rotatable arms with cutting an shredding teeth which were not extending from an axially disposed shaft in the traditional cantilevered fashion. During the evolutionary process of devising the one piece structures of the present invention, it was learned after extensive experimentation that a construction of a cantilevered nature in the spherical configuration was wholly impractical and unworkable owing to the extreme stresses to be exerted on such individually appended arms. By scientific design techniques and much experimentation it was discovered and determined that a practical solution to the problem was the construction of a unitary cutting and shredding structure wherein the arcuate-like arms carry the distributed load stresses of the teeth over the entire peripherical arcuate-like length along each of the entire arms employed. In addition, it was discovered that such unique design provided an unexpected result of providing a device which has no protruding rotational shaft along the axis of rotation, which in turn eliminated a long standing, but not thoroughly understood, problem of increased back-pressure to the flow of sewage owing to the blockage of sewage flow because of the presence of such prior art projecting or protruding stationary shafts.

Thus, the present invention provides an improvement with several unexpected advantaged over the prior art devices. The first advantage is that the one piece cage can be constructed with thinner arcuate ring members while providing stronger, more durable cage constructions. Further, the cost of manufacturing a cage in accordance with the present invention is economically advantageous and adjustment of individual component parts was not required in order to provide reduced vibration during comminuting interegnagement between stationary and rotating cutting teeth.

Another advantage of the present invention arises from the elimination of protruding axial shafts traditionally were made small in diameter as practical to avoid or minimize the problem of material obstruction to the flow of sewage. The need for small size shafts resulted in a structural limitation on the extending arms used to support and carry the cutting teeth during the comminuting process. The present invention eliminates this limitation by the elimination of axial shafts which supported the rotatable members and cutting teeth at the extended ends. Since the support sections for the rotatable cutting teeth are substantially if not completely, removed from the flow path of the supports is no longer a problem. In fact, the support sections can advantageously be made structurally larger to support stronger beefed-up rotational cutting and shredding arcuate-like arms and cutting teeth formed therewith.

Still another advantage of the present invention arises from the simplicity of construction of the one piece cage and rotatable members and the attendant economy of manufacture, efficiency of operation and the enhanced ease of maintenance fo the device for more practical and commerical uses.

Yet another advantage is devived from the elimination of the axial shaft, which minimizes, if not eliminates, the vibration attendant with such prior art axial shafts.

Still a further advantage of the present invention is the provision of a more energy efficient device owing to th elimination of the axial shafts.

Yet a further advantage of the present invention arises from the fact that greater torque can be applied directly to the rotor of the cutter-shredder member to thereby provide smoother rotational action at slower comminuting speeds.

While still another advantage arises from the fact that both the cutter teeth of the rotatable members can be made thinner as well as the cage slots having smaller spacings to thereby provide finer particle sizes of comminuted sewage material.

Heretofore, the need to reduce the shaft diameters has caused a limitation on the amount of rotational torque which could be reasonably applied thereto during the comminuting process. This limitation has been substantially eliminated by removal of the axial shaft and increasing the size and strength of the support sections at opposite ends of the rotor cutting and shredding members, which in turn are capable of higher torques. In a real sense the rotor becomes an extension of the motor drive system shaft.

It is understood that the foregoing disclosure of the invention is intended to be merely exemplary, in that it may be susceptable to modification and variations without departing from the spirit and scope thereof.

What is claimed as new is:

1. An improved comminutor device for sewage system comprising in combination:

a. a one piece hemispherical cup-like cage member forming a concave surface traversely disposed in a sewage system along a flow path of said system, said cage having a plurality of slotted openings cutting said cage member in planes perpendicular to an axis thereof and said slotted openings being formed by a plurality of spaced-apart arcuate elements along said concave cup-like surface and extending toward a down-stream side of said flow path of said system;

b. said cage member having a stationary circular section with spaced-apart cutter and shredding teeth formed along a peripherical edge thereof as an integral part of said hemispherical cup-like cage, each of said teeth being displsed in alignment with a corresponding end of said arcuate elements of said cage and having individual dimensions along said axis and path of flow which are greater than that of said arcuate elements of the cage;

c. a one piece rotatable member having a plurality of cutting and shredding teeth formed on at least two C-shaped diametrically opposed members having a preselected width and thickness rotatably mounted co-axially with said cup-like cage and disposed perpendicular to the flow of sewage on an upstream side of said flow path, said plurality of teeth on each of said C-shaped rotatable members extending for interengagement with said circular section of spaced-apart cutter and shredding teeth of said cage and for intermeshing with said arcuate elements of said cage; and d. driving means for rotating said rotatably mounted C-shaped diametrically opposed members about the axis of said cage for interengaging said teeth of said circular section and for sweeping through said plurality of slotted openings of said cage.

2. The comminutor device defined in claim 1 wherein said cutting and shredding rotatable C-shaped diametrically opposed members are further defined as having a radius less than a radius of said cage as measured from the axis of said device while said plurality of cutting and shredding teeth of said C-shaped rotatable members extend radially a distance greater than a radius of said cage ring elements.

3. The comminutor device defined in claim 1 wherein said C-shaped rotatable members are further defined as having support ring-like members formed therebetween at each end of the C-shaped configuration disposed along the axis of said cage to thereby eliminate structural obstruction to the flow of sewage through an opening formed by the diametrically opposed configuration of the C-shaped members and to provide means whereby said C-shaped members may be rotated about said axis.

4. In an improved comminutor device for an inline sewage system including:

a. a cage adapted to be interposed across a flowing stream of sewage containing solid material;

b. a plurality of slots extending circumferentially of said cage along a full concave peripherical surface thereof;

c. at least one stationary cutter and shredding bar member disposed along an inner concave surface of said cage having a plurality of teeth formed along one edge thereof extending inward toward the axis of the device and forming slots between said teeth of said cutter bars, each of said slots of said cutter bars being disposed to match a corresponding slot of said cage;

d. at least two rotatable arm members disposed about the axis of said device and extending radially therealong adjacent to the concave surface of said cage and said cutter bars and extending radially into the slots of said cage and said cutter bars and intermeshing with said slots and along the full concave peripherical length of said cage and interengaging with said cutter bars during each revolution of said rotatable arms; and e. driving means for rotating said arms in intermeshing action with the slots of said cage and in interengaging action with said teeth of said cutter;

wherein the improvement comprises:

a. a one piece hemispherical cup-like cage member forming a concave surface traversely disposed in said sewage system along a flow path of said system, said cup-like cage having a plurality of slotted openings cutting said cage member in planes perpendicualr to an axis thereof and said slotted openings being formed by a plurality of spaced-apart arcuate elements along said concave cup-like surface and extending toward a downstream side of said flow path of said system;

b. said cage member having a stationary circular section with spaced-apart cutter and shredding teeth formed along a peripherical edge thereof as an integral part of said hemispherical cup-like cage, each of said teeth being disposed in alignment with a corresponding end of said arcuate elements of said cage and having individual dimensions along said axis and path of flow which are greater than that of said arcuate elements of the cage; and c. said rotatable arm members being one integral piece and having a plurality of cutting and shredding teeth formed on at least two C-shaped diametrically opposed and disposed members having a preselected width, rotatably mounted co-axially with said cup-like cage and disposed perpendicular to the flow of sewage on an upstream side of said flow path, said plurality of teeth on each of said C-shaped rotatable members extending for interengagement with said teeth of said circular section of spaced-apart cutter and shredding teeth of said cage and for intermeshing with said arcuate elements of said cage.

5. The improvement defined in claim 4 wherein said cutting and shredding rotatable C-shaped diametrically opposed members are further defined as having a radius less than a radius of said cage as measured from the axis of said device while said plurality of cutting and shredding teeth of said C-shaped rotatable members extend radially a distance greater than a radius of said cage ring members.

6. The improvement defined in claim 4 herein said C-shaped rotatable members are further defined as having support ring-like members formed therebetween at each end of the C-shaped configuration disposed along the axis of said cage to thereby eliminate structural obstruction to the flow of sewage through an opening formed by diametrically opposed configuration of the C-shaped members and to provide means whereby said C-shaped members may be rotated about said axis.

* * * * *